US010480738B1

(12) United States Patent
Nelson

(10) Patent No.: US 10,480,738 B1
(45) **Date of Patent: *Nov. 19, 2019**

(54) ELECTRICAL DEVICE

(71) Applicant: Neal Nelson, South Elgin, IL (US)

(72) Inventor: Neal Nelson, South Elgin, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/059,240

(22) Filed: Aug. 9, 2018

Related U.S. Application Data

(63) Continuation of application No. 14/645,060, filed on Mar. 11, 2015, now Pat. No. 10,072,803.

(51) Int. Cl.

| | |
|---|---|
| ***F21V 23/00*** | (2015.01) |
| ***F21S 41/141*** | (2018.01) |
| ***A47B 77/08*** | (2006.01) |
| ***A47F 3/00*** | (2006.01) |
| ***F21V 23/06*** | (2006.01) |
| ***F21S 9/00*** | (2006.01) |
| ***F21V 33/00*** | (2006.01) |
| ***A47B 96/00*** | (2006.01) |
| *F21L 4/00* | (2006.01) |
| *F21Y 103/00* | (2016.01) |
| *F21W 131/301* | (2006.01) |

(52) U.S. Cl.

CPC ..... *F21S 41/141* (2018.01); *A47B 77/08* (2013.01); *A47B 96/00* (2013.01); *A47F 3/001* (2013.01); *F21S 9/00* (2013.01); *F21V 23/001* (2013.01); *F21V 23/06* (2013.01); *F21V 33/0012* (2013.01); *F21W 2131/301* (2013.01); *F21Y 2103/00* (2013.01)

(58) Field of Classification Search

CPC .. F21S 4/008; F21S 9/00; A47B 77/08; A47B 96/00; A47F 3/001; F21V 23/001; F21V 23/06; F21V 33/0012; F21W 2131/301; F21Y 2103/003

USPC ..... 362/190, 559, 570, 565, 581, 145, 220, 362/221, 225, 217.13, 217, 217.14, 362/217.17, 646, 249.01, 249.12, 285

See application file for complete search history.

(56) References Cited

U.S. PATENT DOCUMENTS

2003/0112627 A1* 6/2003 Deese ..... F21V 21/0832 362/249.01
2003/0189831 A1* 10/2003 Yoneda ..... F21K 9/00 362/294
2011/0250775 A1* 10/2011 Bies ..... H01R 4/4836 439/296
2012/0002417 A1* 1/2012 Li ..... F21V 17/007 362/249.02

* cited by examiner

*Primary Examiner* — William J Carter
*Assistant Examiner* — Omar Rojas Cadima
(74) *Attorney, Agent, or Firm* — Peter K. Trzyna, Esq.

(57) ABSTRACT

An electrical device, method of making the device, and method of using the device. The device can be incorporated into illumination configurations, as in lighting elements.

16 Claims, 5 Drawing Sheets

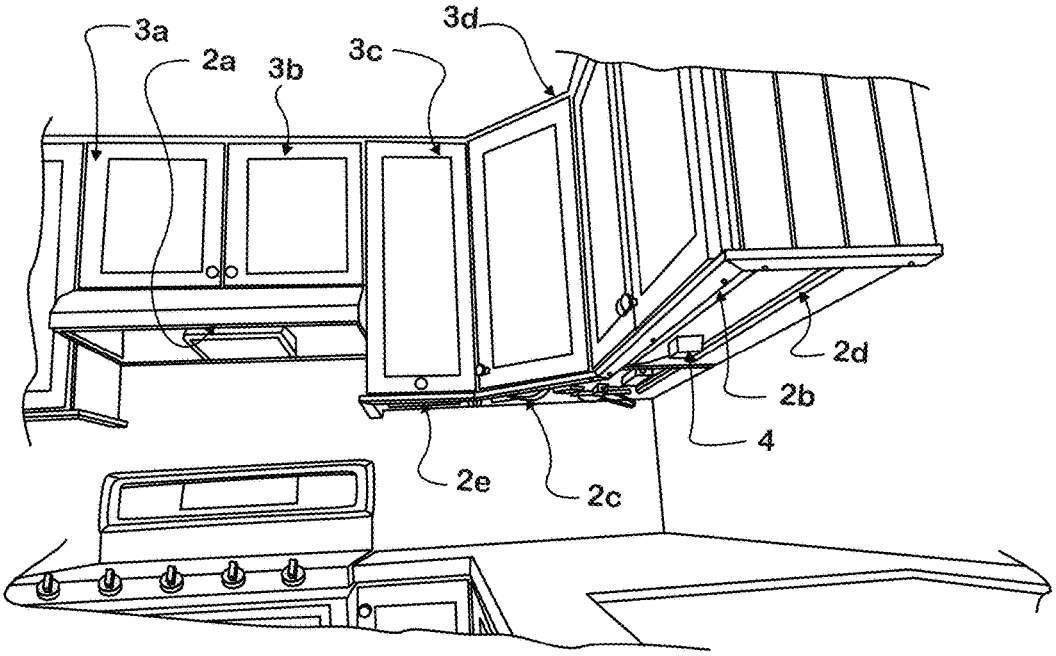
FIG. 1
FIG. 2
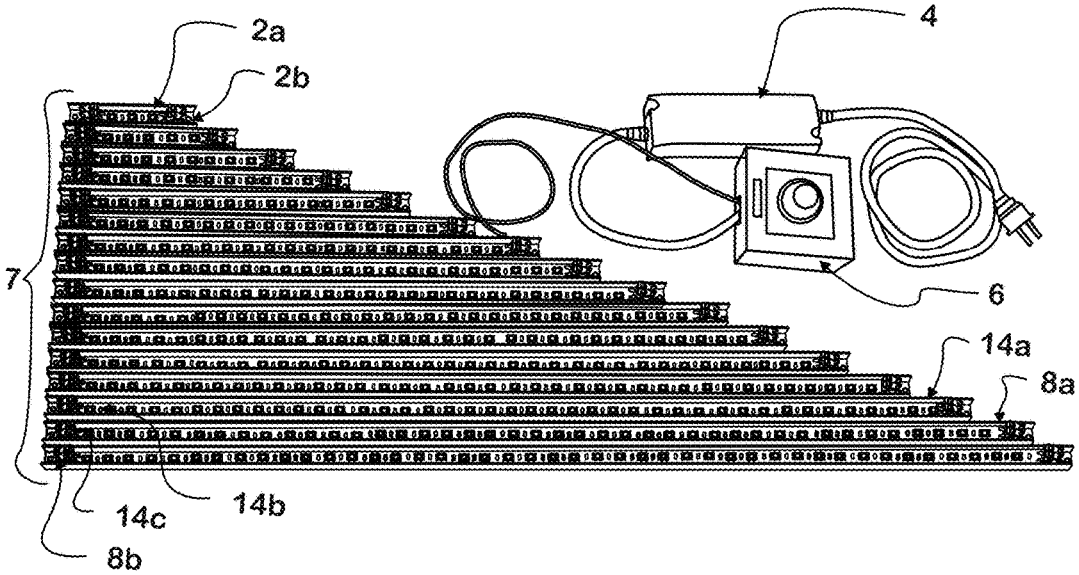

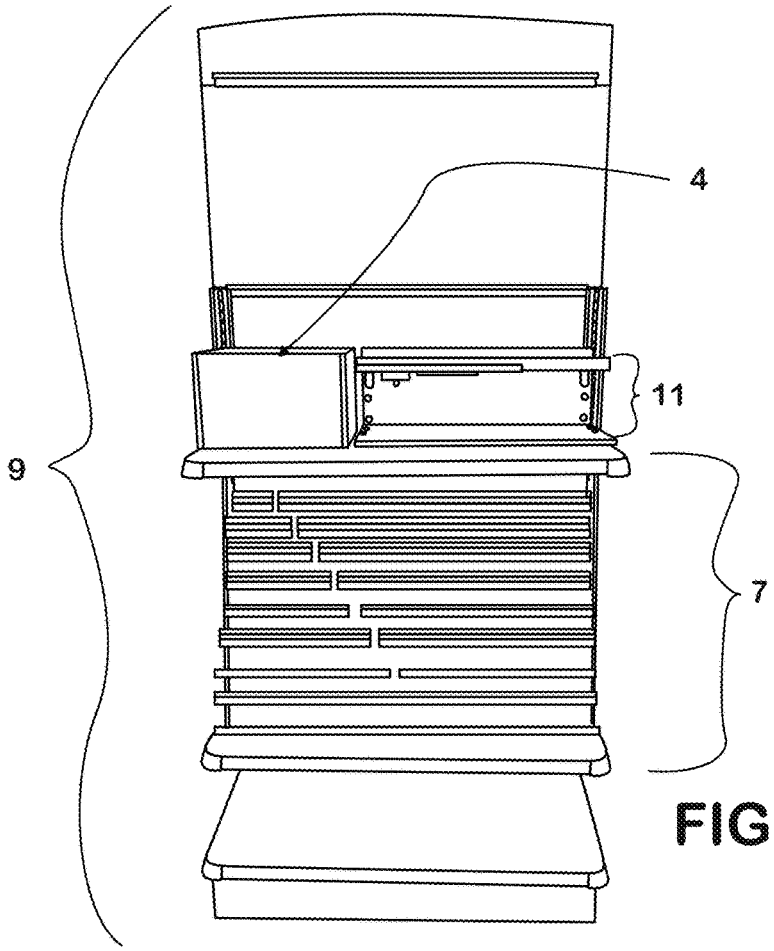
FIG. 3
FIG. 4
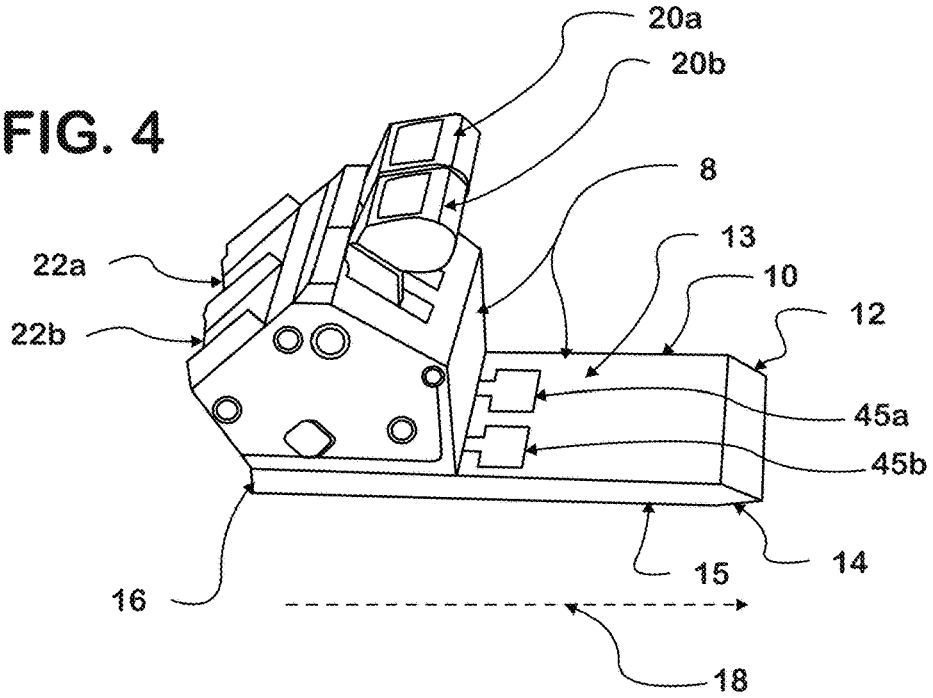

ELECTRICAL DEVICE

I. PRIORITY STATEMENT

The present patent application is a continuation of U.S. patent application Ser. No. 14/645,060, filed Mar. 11, 2015, pending, being incorporated by reference completely as if restated totally herein.

II. BRIEF DESCRIPTION OF THE FIGURES

FIG. 1 is an illustration of an embodiment installed on an underside of kitchen cabinets;

FIG. 2 is an illustration of an embodiment of components for a lighting system;

FIG. 3 is an illustration of an embodiment of a display with kit components;

FIG. 4 is an illustration of an embodiment of an interconnect device;

Figure 8:
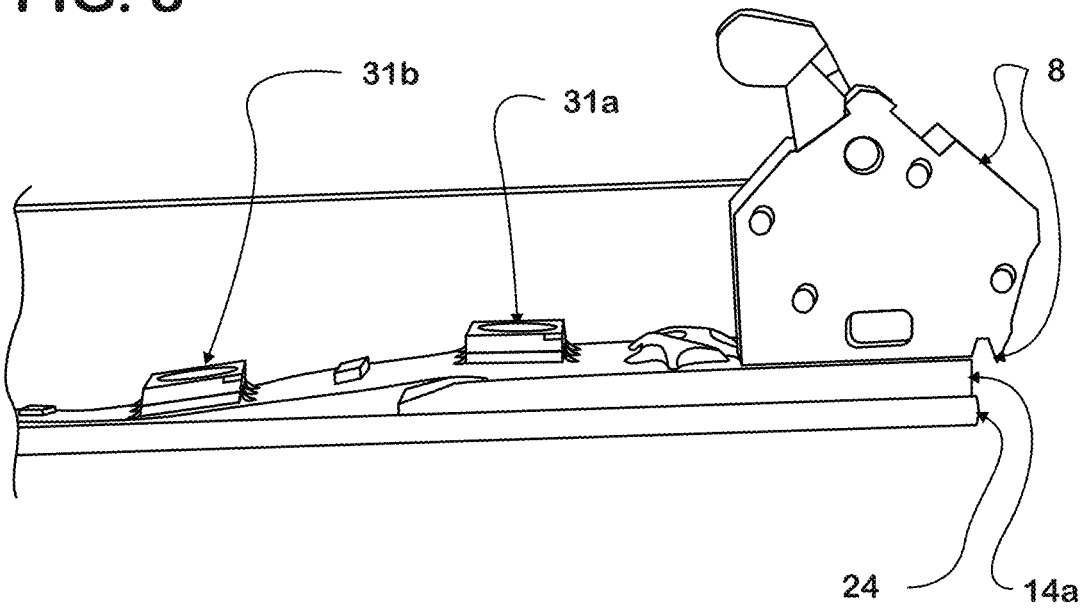
Figure 9:
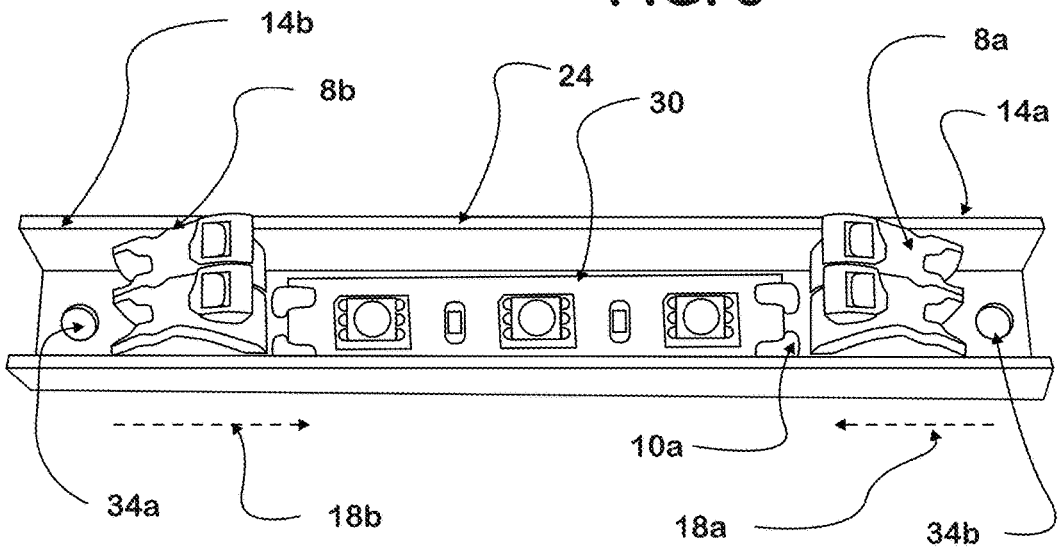
Figure 10:
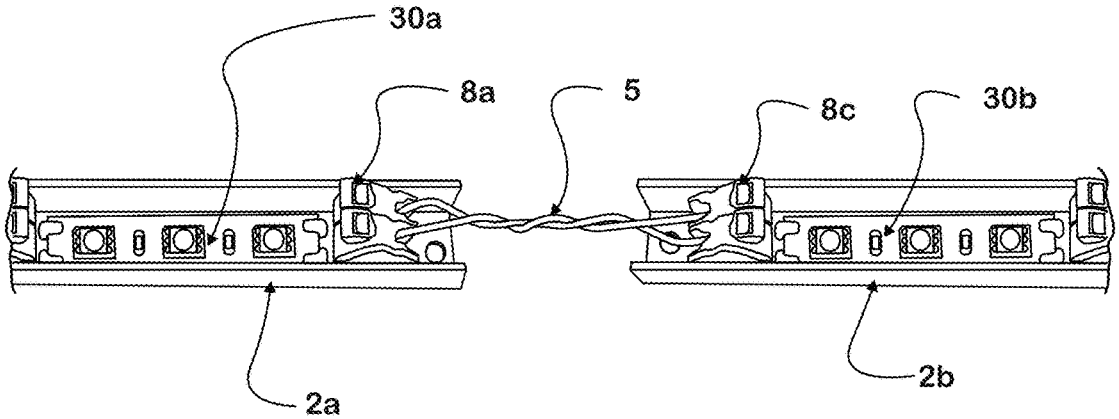

FIG. 8 is an illustration of an embodiment of an interconnect device in connection with a support and a strip of Light Emitting Diodes; and FIG. 9 is an illustration of an embodiment of interconnect devices in connection with a support and a strip of Light Emitting Diodes; and FIG. 10 is an illustration of an embodiment of wiring from an end of one lighting element to an end of another lighting element.

III. DETAILED DISCLOSURE OF EMBODIMENTS

Generally, FIG. 1 illustrates an embodiment in which an electrical device is usefully employed in a lighting system. The lighting system has lighting elements configured and installed on surfaces of kitchen cabinets. A kitchen implementation is used illustratively as the components are not limited use in any particular room or in an installation with cabinets.

Further, the lighting system elements need not be limited to the underside or be in a linear or planar orientation. In some embodiments, the lighting elements are implemented without a mechanical joint connecting them, using instead the wiring to connect the elements, which are in turn mounted to whatever surfaces are of interest. Thus, embodiments can be implemented in many geometries, including three-dimensionally with configurations of one or more lighting elements connected, if so desired, in series, parallel, or a combination thereof, and thence to an appropriate source(s) of power. Thus, in some configurations, multiple lighting elements can be configured in a "daisy chained" fashion with interconnecting wires between each element, while the source-proximate end of the daisy chain has wires connected to an appropriate power source, possibly through a dimming device. Additional illustrative configurations split into two or more single or daisy-chained strings of lighting elements at any point where interconnecting wires attach to an end of a lighting element. The lighting elements can therefore be combined in an angled orientation, for example, to match facets of cabinets, and/or be in orientations that are horizontal and/or vertical and/or there between, and combinations thereof.

In the prophetic illustration in FIG. 1, lighting elements 2(*a-e*) are shown mounted to kitchen cabinets 3(*a-d*) which have a variety of different widths, heights, and angles to meet various storage needs and room angles. Cabinets such as these come in industry-standard sizes of 3 inch linear increments, and the lighting elements 2(*a-e*) can have cooperating increments (see FIG. 2) if so desired, to fit according to these (or other) industry standard increments. That is, the lighting elements 2 can, but need not always, be made in lengths sized to approximately fit the variety of lengths (widths, heights, angles, etc.) for the cabinets or other standardized building components. A plurality of a lighting elements 2 can be configured collectively to fit in an installation that closely matches the width, angles, height, etc. of any, of the different kitchen cabinets 3.

Embodiments herein can utilize wiring 5 (see FIG. 7) from one lighting element 2*b* to another 2c to allow a single power supply 4 to provide power to a number of lighting elements 2, 34, etc. The power supply can be Mean Well PLN-30-12 of Mean Well Taiwan, No. 28, Wuquan 3rd Rd., Wugu Dist., New Taipei City 24891, Taiwan (R.O.C.)

Other embodiments can, if so desired, utilize more than one power supply 4 and sets of lighting elements 2 collectively specially adapted to be combined and positioned, for example, according to the variety of widths, lengths, etc. of the kitchen (bathroom, etc.) cabinets 3 and shelves, etc. so as to be affixed thereto. In other embodiments, the lighting elements 2 can be specially adapted to be combined and positioned to cooperate (e.g., electrically, illuminatively, structurally, etc.) with other apparatus for lighting, heating, steam generating, cooking, refrigerating, drying, ventilating, water supply and sanitary purposes.

FIG. 2 shows a variety of lighting elements (2*a*, etc.) of lengths differing by a scaling factor, e.g., 1 inch, 10 mm, or as desired, the elements in an array 7 from which a selection can be made to fit a desired application. To cooperate with consumer-selected elements 2 in the array 7, FIG. 2 shows a power supply 4 that accepts input power, e.g., from some source such as a residential electrical outlet, and converts this power to the appropriate voltage and current required to operate the lighting elements 2. Also illustrated is a dimmer module 6 which can be connected to throttle the electricity to the lighting element(s), e.g., between the output of the power supply 4 and the connections to the lighting element 2 and in some cases, other elements. The dimmer module 6 can, but need not always, be used in a configuration or operation for applications discussed herein, but may be used if so desired, e.g., mounted to the same or a different mounting surface as one or more of the lighting elements 2. Alternatively, the power supply 4 itself may have a capacity to perform the dimming function through internal circuitry.

FIG. 2 also shows that each lighting element 2 has at least one interconnect device 8*c*, but there may be multiple interconnect devices 8*b*, 8*c*, etc. at one end 14*a*, 14*b*, etc. As discussed below, each interconnect 8 has a set of at least two, but possibly more than two, terminals 22, each of the terminals 22 adjacent to a support 10 (see, e.g., FIG. 4). These interconnect devices 8 may be of the sort that allow a lighting element 2 to be connected to a power supply 4, if so desired, through a dimmer module 6, and/or to another lighting element 2, e.g., to connect lighting element 2*a* to another lighting element 2*b* and so forth, so as to form a daisy chain configuration. While the lighting elements 2 can be in contact with each other when mounted, in certain implementations, the elements 2 are devoid of a mechanical connection linking one lighting element 2 to another, other than the wiring 5 that is providing power. Therefore, in implementations devoid of a mechanical joint between the elements 2, other than the wiring 5, any combination (within the limits of the electricity) of the various lengths of lighting elements 2 can be interconnected in a configuration of choice, in one dimension, two dimensions, or three dimensions of mounting surface, with elements in series, parallel, or both.

The array 7 is shown in FIG. 2 as having lengths organized into increasing or lengths, which can, if so desired, be presented in a display 9 illustrated in FIG. 3. The display 9 contains the array 7 as components of a kit with contents adapted to be positioned and surface-mounted respectively with the lighting elements 2 being devoid of a mechanical joint other than being connected by wiring 5 in the manner discussed herein, to share the power supply 4 to cooperate as a lighting system, wherein the lighting elements 2 are substantially identical except for length and the corresponding number of LEDs that fit with the length, in some cases, sharing a dimmer 6. In FIG. 3, dimmer 6 and wiring 5 are not shown, but a demonstrative installation 11 is, but need not always, be provided.

Figure 5:
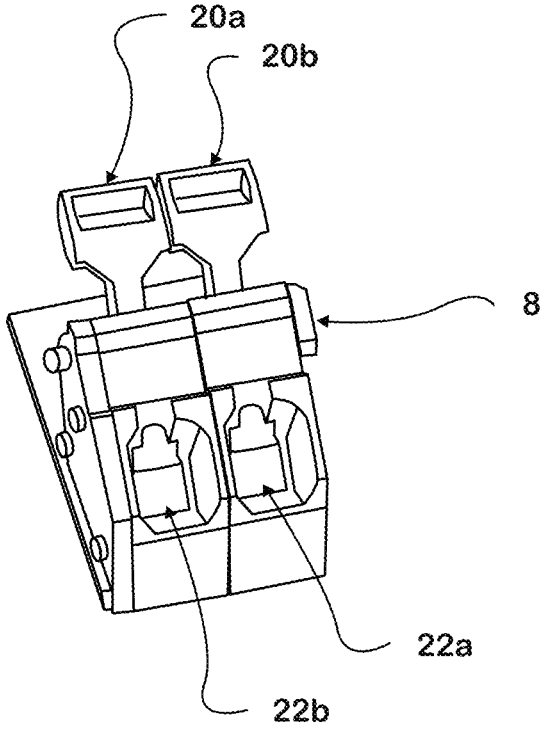
FIG. 5 is an illustration of an embodiment of a portion of an interconnect device.

FIGS. 4 and 5 illustrate one of the many types of interconnect 8 devices that can be used. FIG. 4 is a side view and FIG. 5 is an end view, both showing an interconnect 8 body and handles 20(*a, b*) of the spring loaded cage connector terminal ports 22(*a, b*). The cage connector's handles 20, when depressed, open the connector terminal ports 22(*a, b*) so that interconnect wires of wiring 5 (not shown in FIG. 3) can be removed or inserted so as to be detachably attachable. The handles 20(*a, b*) and ports 22(*a, b*) are spring loaded so that when pressure on the handles 20(*a, b*) is released the connector ports close, based on spring tension, to establish secure mechanical and electrical contact with the interconnect wires.

Other kinds of interconnects can be used, depending on the implementation desired. Typically, though not necessarily, there is an electro-mechanical device for joining electrical circuits as an interface using a mechanical assembly. A terminal is a simple type of electrical connector that connects two or more wires to a single connection point. Wire nuts are another type of single point connector. Usually connectors utilize plugs (male-ended) and jacks (female-ended). The connection may be temporary or serve as a permanent electrical joint between two wires or devices. An adapter can be used to effectively bring together dissimilar connectors. Interconnects can include keying and/or locking mechanisms, and among the many possibilities for interconnects are terminal blocks, posts, crimp-on, insulation displacement, plug and socket, component and device, blade, ring and spade, hybrid, banana, barrier strip/spade lug, crimp, screw, and DIN connectors. Solder etc. is a less flexible connector.

Interconnect 8 is mounted on a support 10, which can be made of an electrical insulator, such as resin impregnated glass fiber, plastic, glass or other electrically, substantially non-conductive material. Depending on the implementation desired, the support 10 may be dimensioned to have a bottom length in the range of 20 mm to 40 mm. Support 10 can have a width based on the number of interconnects 8 supported (there can be more than one set of interconnects 8 at an end so as to have LED strips in parallel) and the dimensions of a housing 24. Support 10 can have a thickness of range of 2 mm to 4 mm, or such other dimensions that accommodate an LED strip 30 and provide stability with respect to a housing 24. LED strip 30 can be such as a model YL-5050 SMD-L60-WW of KINDOM OPTO-ELECTRONIC Co., Ltd Jiajun Industrial Park, Helong Road, Jiahe, Baiyun District, Guangzhou City, China.

In some embodiments, the support 10 can have a lesser thickness 12 in one direction (illustrated with a dashed line 18) defined by one end 14 with respect to another end 16 of support 10. For example, the support 10 can be configured so that there is a plane 13 proximate to the interconnect 8 and another plane 15 distal to the interconnect 8 that is larger than the proximate plane 13, so that the different lengths proscribe a sloping, tapering, or curving region, indicating a direction 18. In operation this feature facilitates transition of a flexible LED strip 30 from a housing 24, e.g., as illustrated in FIG. 8.

In implementations in which there are multiple interconnects 8*a*, 8*b*, the directions 18*a*, 18*b* of two of the supports 10*a*, 10*b* can be opposing directions, i.e., pointing toward each other with the LED strip between the interconnects 8*a*, 8*b*. In this orientation for the supports 10*a*, 10*b*, it is possible to have the terminals 22*a* of one of the interconnects 8*a* oriented with respect to the terminals 22*b* of the other of the interconnects 8*b* so that the terminals 22*a*, 22*b* point away from each other, while the supports 10*a*, 10*b* point toward each other.

Depending on the implementation, here in the teaching example in FIG. 4, the interconnect 8 assembly can include electrical extensions such as solder pads 45*a*, 45*b*, or other such manner of establishing an electrical connection between the interconnect 8 and a Light Emitting Diode strip 30.

Figure 6:
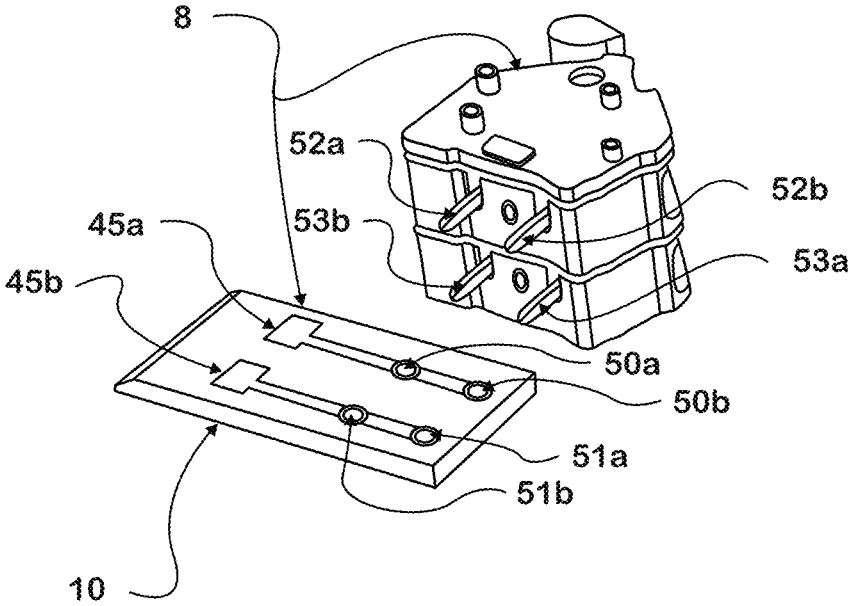
FIG. 6 is an illustration of an embodiment of an interconnect device in a disassembled view.

In some but not all embodiments, it may be desirable to have circuitry 48 (FIG. 6) between the interconnect 8 and the strip 30, which includes the solder pads 45. And in some, but not all implementations of this type, interconnect 8 can have at least one conductive protrusion 52*a*, 52*b*, in electrical connection with terminal 22*a*, and at least one protrusion 53*a*, 53*b* in electrical connection with terminal 22*b*. The circuitry 48 can include at least on via 50*a*, 50*b* structured to accommodate the at least one conductive protrusion 52*a*, 52*b*, and at least one via 51*a*, 51*b*. The protrusions 52, 53 mate with vias (e.g., plated vias) 51, 52 so that the circuitry establishes electrical connections from the terminals 22*a*, 22*b* to the solder pads 45*a*, 45*b*. The protrusions 52, 53 can be soldered to plated vias 50, 51, with the extra set of protrusions 52*b*, 53*b*, and vias 50*b* and 51*b* used for redundancy and added support, of such is desired. If the plated vias 50 and/or protrusions 52 extend through the support 10, and if the housing 24 is electrically conductive, an insulator can be provided between the plated vias 50 and/or protrusions 52 and the housing 24.

Figure 7:
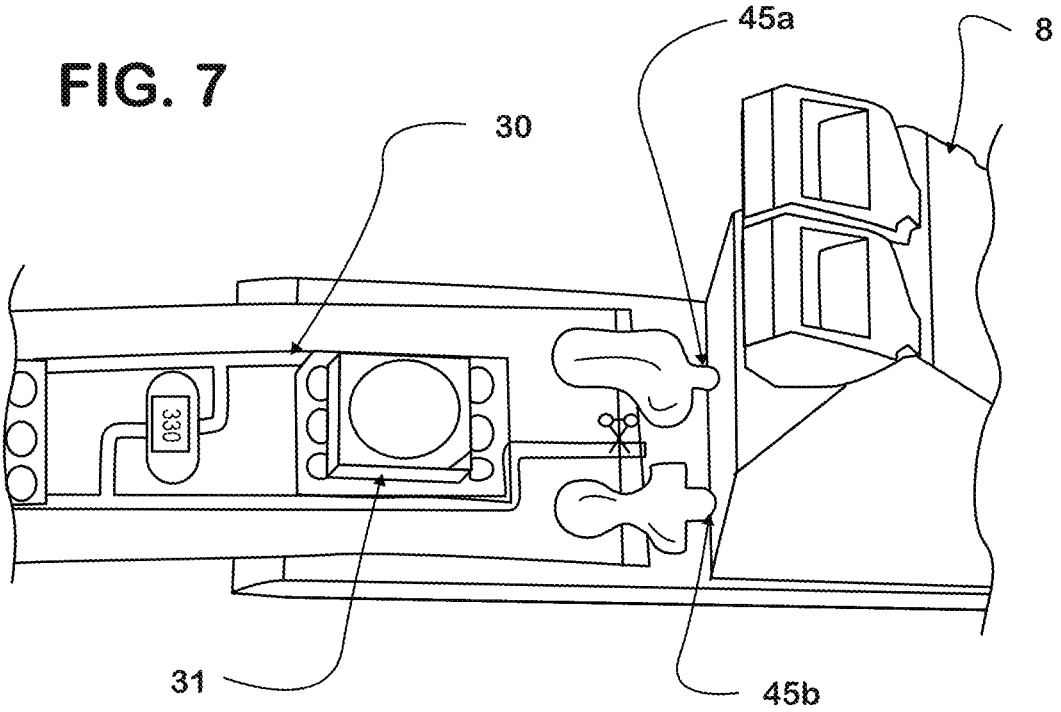
FIG. 7 is an illustration of an embodiment of an interconnect device in connection with a support and a strip of Light Emitting Diodes.

FIGS. 7 and 8 illustrate LED strip 30 having at least one LED 31. LED strip 30 is operably connected to interconnect 8 by soldering LED strip 30's connections to solder pads 45*a* and 45*b*. Note that the circuitry 48 is structured to have the solder pads 45 positioned to mate with the soldering LED strip 30's connections. Alternatives to soldering such as spot welding, mechanical friction fit or other methodologies may also be used to establish the required electrical connections. Furthermore, the interconnect device 8, shown here as an assembly of an interconnect 8 and support 10 can be manufactured as a single assembly with the circuitry 45, 48, 52 included as part of the integrated device.

FIG. 8 illustrates a side view of the interconnect 8 located with respect to the housing 24. The housing can be made of metal, plastic, wood, etc. In embodiments using the support 10, the support 10 can be mounted to the housing by way of adhesive, screw, bolt, weld, or other manner of securing. A housing 24 can have an end 14*a* adjacent to one of the interconnects 8*a*. As shown in FIG. 9, there is a second end 14*b* adjacent a second of the interconnects 8*b*, such that the interconnects 8 are oriented so that the directions 18*a* and 18*b* of the supports 10 are opposing directions, or said another way, so that the directions 18*a* and 18*b* point to an opposite side of the support 10*a* and 10*b* than the terminals 22*a* and 22*b*.

In FIG. 9, a strip of light-emitting diodes 30 is operably connected intermediate the terminals 22 of the two interconnects 8*a* and 8*b* so as to power the diodes 31 etc. The strip 30 can be adhered or otherwise mounted to housing 24. If so desired for one embodiment or another, LEDs 31 can be mounted on a rigid, semi-rigid or flexible circuit board to form a strip of LEDs 30. The strip of LEDs 30 can be mounted on housing 24 adhesively or by mechanical mounting. The housing 24 and LED strip 30, when combined with interconnect devices 8 at each end of the housing form, lighting element 2. FIG. 9 also shows mounting adaptations 34*a* and 34*b*, in the illustrated embodiment, holes bored in housing 24. Other mounting adaptations can be used, e.g., brackets, adhesive, spikes emerging from housing 24 to be driven into mounting surfaces, locations for fasteners overlapping the housing 24 to connect the housing 24 to a surface, etc.

In FIG. 10, lighting element 2*a* is shown operably connected to lighting element 2*b* by wiring 5 that is detachably attached to interconnects 8*a* and 8*c*, owing no mechanical joint between 2*a* and 2*b*. Power supply 4 (FIG. 2) can be connected to one of the set of terminals 22 of interconnect 8*b* of the lighting element 2*a* so as to drive the strip of light-emitting diodes 30*a*, and if so desired, the wiring 5 can communicate power to strip 30*b* via interconnects 8*a* and 8*c*. Embodiments that use multiple lighting elements 2 can be collectively integrated in such a way that when electric current is supplied to the interconnect device 8*a* at one end of a lighting element 2, a portion of that current is bussed through the strip 30*a* to the interconnect device 8*b* at the other end of that lighting element 2. This allows multiple lighting elements 2 to be configured as a chain where current is supplied to one end of the chain, and then multiple lighting elements 2 are connected one to another by using sections of wiring 5 (such as an interconnecting cable). The lighting elements 2 are therefore structured to be selectably positioned with respect to each other when surface anchored by mounting adaptations on the housing 24, e.g., holes for screws or nails, clips, etc. The lighting elements 2 can be in series, parallel, or a combination, with or without other lighting fixtures as may be desired, and having orientations in two or more dimensions, as may be desired, powered by the power supply 4 with no mechanical joint between the lighting elements 2 but for wiring 52 that is detachably attachable to one of the sets of the terminals 22 and to the other set of terminals 22.

Embodiments, as noted above, can be modular. For example, one lighting element 2 can have a length and/or a number of the diodes that differs from another by a uniform scaling standard, e.g., one inch (10 mm, etc.) uniform difference between each lighting element 2. A set of such modular lighting elements can be combined in the above-mentioned array 7, for example, in a display 9 as shown in FIGS. 2 and 3.

The foregoing description of illustrated embodiments, including what is described in the Abstract are not intended to be exhaustive or to be limiting to the precise forms disclosed herein. While specific embodiments and examples are prophetically described herein for teaching-by-illustration purposes, various equivalent modifications should be recognized as possible within the spirit and scope of what is disclosed herein, as those skilled in the relevant art will recognize and appreciate. These modifications may be made in light of the foregoing description of illustrated embodiments and are to be included within the true spirit and scope of the disclosure.

Accordingly, appreciation is requested for the robust range of possibilities flowing from the core teaching herein. More broadly, however, the terms and expressions which have been employed herein are used as terms of teaching and not of limitation, and there is no intention, in the use of such terms and expressions, of excluding equivalents of the features shown and described, or portions thereof, it being recognized that various modifications are possible within the scope of the embodiments contemplated and suggested herein. Further, various embodiments are as described and suggested herein. Although the disclosure herein has been described with reference to specific embodiments, the disclosures are intended to be illustrative and are not intended to be limiting. Various modifications and applications may occur to those skilled in the art without departing from the true spirit and scope defined herein.

Thus, although illustrative embodiments have been described in detail above, it is respectfully requested that appreciation be given for the modifications that can be made based on the exemplary embodiments, implementations, and variations, without materially departing from the novel teachings and advantages herein. As indicated herein, means-plus-function language is intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment fastening wooden parts, a nail and a screw may be equivalent structures.

I claim:

1. An article of manufacture including:

a lighting element that includes two interconnects, two supports, and a housing, each said interconnect including a set of two or more terminals for wiring connections, each said terminal located on a solder pad, each said solder pad soldered to an electrical connection of a strip of light-emitting diodes and located on one of said supports, each said support configured so that there is an interconnect-proximate plane, adjacent the solder pads of one of said sets of terminals, and an interconnect-distal plane that is larger than the interconnect-proximate plane, so that different lengths of the interconnect-proximate plane and the interconnect-distal plane proscribe a sloping, tapering, or curving region of the support and indicate a direction inward to ends of the housing, and wherein the housing that contains the interconnects with their supports within the ends of the housing, the housing including a hole adjacent each said end and located to surface anchor the housing by the ends, wherein the strip of light-emitting diodes is in contact with the housing and the interconnect-proximate planes and the regions of the support, between the solder pads and between walls of the housing, and is operably connected intermediate the sets of the terminals and substantially intermediate the directions, so as to receive power for the strip of light-emitting diodes from one said set of the terminals and communicate the power to another said set of the terminals.

2. The article of claim 1, wherein with the interconnect-distal plane has a length in the range of 20 mm to 40 mm.

3. The article of claim 1, wherein with the support has a thickness in the range of 2 mm to 4 mm.

4. A process of making an apparatus, the process including:

assembling a lighting element by combining at least two interconnects, two supports, and a housing, each said interconnect including a set of two or more terminals for wiring connections, each said terminal located on a solder pad, each said solder pad soldered to an electrical connection of a strip of light-emitting diodes and located on one of said supports, each said support configured so that there is an interconnect-proximate plane, adjacent the solder pads of one of said sets of terminals, and an interconnect-distal plane that is larger than the interconnect-proximate plane, so that different lengths of the interconnect-proximate plane and the interconnect-distal plane proscribe a sloping, tapering, or curving region of the support and indicate a direction inward to ends of the housing, and wherein the housing contains the interconnects with their supports within the ends of the housing, wherein the strip of light-emitting diodes is positioned in contact with the housing and the interconnect-proximate planes and the regions, between the solder pads and between walls of the housing, and is operably connected intermediate the sets of the terminals and substantially intermediate the directions, so as to receive power for the strip of diodes from one said set of the terminals and communicates the power to another said set of the terminals.

5. The article of claim 1, wherein the interconnect-distal plane has a length in the range of 20 mm to 40 mm, and the support has a thickness in the range of 2 mm to 4 mm.

6. The process of claim 4, wherein the locating is carried out with the interconnect-distal plane having a length in the range of 20 mm to 40 mm, and the support having a thickness in the range of 2 mm to 4 mm and so that the strip of light-emitting diodes is not co-planar with the housing and is not co-planar with the interconnect-proximate plane and the interconnect-distal plane.

7. The process of claim 6, wherein each of the terminals is connected to an electrically conductive protrusion extending into a plated via that is connected to one of the solder pads.

8. The process of claim 6, wherein each of the terminals comprise handles of spring-loaded cage connector terminal ports, such that the handles, when depressed, open the connector terminal ports so that wires can be removed or inserted, the handles and ports being spring loaded so that when pressure on the handles is released, the connector ports close, based on spring tension, to establish secure mechanical and electrical contact with wiring inserted therein.

9. The process of claim 4, further including locating the lighting element in a kit that includes a power supply structured to change household electricity sufficient to drive the strip of light-emitting diodes.

10. The process of claim 4, further including providing a display of consumer-selectable, kit components, the display organizing a variety of lighting elements from which a consumer-selection can be made among an array of lighting elements made of lengths differing by a scaling factor of 1 inch or 10 mm, including said first lighting element.

11. A product produced by the process of claim 4.

12. A process of using an apparatus, the process including:

installing, adjacent a residential electrical outlet, a lighting element that includes two interconnects, two supports, and a housing, each said interconnect including a set of two or more terminals for wiring connections, and each said terminal located on a solder pad, each said solder pad soldered to an electrical connection of a strip of light-emitting diodes and located on one of said supports, each said support configured so that there is an interconnect-proximate plane, adjacent the solder pads of one of said sets of terminals, and an interconnect-distal plane that is larger than the interconnect-proximate plane, so that different lengths of the interconnect-proximate plane and the interconnect-distal plane proscribe a sloping, tapering, or curving region of the support and indicate a direction inward to ends of the housing, wherein the housing contains the interconnects with their supports within the ends of the housing, the housing includes a hole exterior to each of the supports, located to surface anchor the housing, wherein the strip of light-emitting diodes is in contact with the interconnect-proximate planes and the regions, the strip of light emitting diodes is located between the solder pads and intermediate walls of the housing, and is operably connected intermediate the sets of the terminals and substantially intermediate the directions, so as to receive power for the strip of diodes from one said set of the terminals and communicate the power to another said set of the terminals; and locating a power supply, structured to change household electricity sufficient to drive the strip of light-emitting diodes, intermediate the residential electrical outlet and the lighting element so as to provide power to strip of light-emitting diodes.

13. The process of claim 12, wherein the locating is carried out in a kitchen.

14. The process of claim 12, wherein the lighting element is a first lighting element, and further including installing, adjacent the first lighting element, a second lighting element that includes two second interconnects, two supports, and a housing, each said second interconnect including a set of two or more second terminals for wiring connections, and each said second terminal located on a second solder pad, each said solder pad soldered to an electrical second connection of a second strip of light-emitting diodes and located on one of said second supports, each said second support configured so that there is a second interconnect-proximate plane, adjacent the second solder pads of one of said sets of terminals, and a second interconnect-distal plane that is larger than the second interconnect-proximate plane, so that different second lengths of the second interconnect-proximate plane and the second interconnect-distal plane proscribe a sloping, tapering, or curving second region and indicate a second direction inward to second ends of the housing, wherein the second housing differs from the first housing by a scaling factor of 1 inch or 10 mm and contains the second interconnects with their second supports within the second ends of the second housing, the second housing including a second hole exterior to each of the second supports, adjacent each said second end, and located to surface anchor the second housing by the second ends, such that the second strip of light-emitting diodes, located in contact with the second region and the interconnect-proximate plane, receives power for the second strip of diodes from one said second set of the second terminals and communicates the power to another said second set of the second terminals; and electrically connecting the first lighting element and the second lighting element.

15. The process of claim 14, wherein the locating is carried out in a kitchen.

16. An apparatus comprising:

a display comprising consumer-selectable lighting elements made of lengths differing by a scaling factor of 1 inch or 10 mm, the lighting elements including:

a first lighting element that includes two interconnects, two supports, and a housing, each said interconnect including a set of two or more terminals for wiring connections, and said terminal located on a solder pad soldered to an electrical connection of a strip of light-emitting diodes, each said solder pad located on one of said supports, each said support configured so that there is an interconnect-proximate plane and an interconnect-distal plane that is larger than the interconnect-proximate plane, so that different lengths of the interconnect-proximate plane and the interconnect-distal plane proscribe a sloping, tapering, or curved region of the support and indicate a direction inward to ends of the housing, the supports mounted on a housing that contains the interconnects and the supports within the ends of the housing, the housing including a hole located to surface anchor the housing; wherein an end of the strip of light-emitting diodes is in contact with one of the interconnect-proximate planes and another end of the strip of light-emitting diodes is in contact with another of the interconnect-proximate planes, the strip of light emitting diodes being located between the solder pads and intermediate walls of the housing, in contact with the housing and the region and operably connected intermediate the sets of the terminals and positioned to receive power for the strip of diodes from one said set of the terminals and communicate the power to another said set of the terminals; and a second lighting element that includes two second interconnects, two supports, and a housing, each said second interconnect including a set of two or more second terminals for wiring connections, and each said second terminal located on a second solder pad, each said solder pad soldered to an electrical second connection of a second strip of light-emitting diodes and located on one of said second supports, each said second support configured so that there is a second interconnect-proximate plane, adjacent the second solder pads of one of said sets of terminals, and a second interconnect-distal plane that is larger than the second interconnect-proximate plane, so that different second lengths of the second interconnect-proximate plane and the second interconnect-distal plane proscribe a sloping, tapering, or curving second region and indicate a second direction inward to second ends of the housing, wherein the second housing contains the second interconnects with their second supports within the second ends of the second housing, the second housing including a second hole exterior to each of the second supports, adjacent each said second end, and located to surface anchor the second housing by the second ends, such that the second strip of light-emitting diodes, located in contact with the second region and the interconnect-proximate plane, receives power for the second strip of diodes from one said second set of the second terminals and communicates the power to another said second set of the second terminals; and wherein the display also comprises a power supply suitable for driving at least one of the strips of light-emitting diodes.

* * * * *